US007113713B2

(12) United States Patent
Soda et al.

(10) Patent No.: US 7,113,713 B2
(45) Date of Patent: Sep. 26, 2006

(54) IMAGE FORMING APPARATUS USING AN ELECTROPHOTOGRAPHIC PROCESS

(75) Inventors: Takamitsu Soda, Shizuoka (JP); Tatsuya Kobayashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 10/921,183

(22) Filed: Aug. 19, 2004

(65) Prior Publication Data

US 2005/0078972 A1 Apr. 14, 2005

(30) Foreign Application Priority Data

Aug. 22, 2003 (JP) ..... 2003-298824

(51) Int. Cl.
*G03G 15/16* (2006.01)
*G03G 15/00* (2006.01)

(52) U.S. Cl. ..... 399/66; 399/44; 399/101

(58) Field of Classification Search ..... 399/43, 399/44, 66, 101, 302, 308
See application file for complete search history.

(56) References Cited

U.S. PATENT DOCUMENTS 5,250,994 A 10/1993 Ito et al.
5,697,028 A 12/1997 Kobayashi et al. ..... 399/281
5,732,310 A 3/1998 Hiroshima et al. ..... 399/101
5,740,502 A 4/1998 Kobayashi et al. ..... 399/128
5,974,281 A * 10/1999 Fujii et al. ..... 399/66
5,991,566 A * 11/1999 Tanaka et al. ..... 399/101
5,999,763 A * 12/1999 Hiroshima et al. ..... 399/66
6,226,467 B1 5/2001 Nakagawa et al. ..... 399/55
6,498,907 B1 * 12/2002 Yoda ..... 399/44
2003/0219286 A1 11/2003 Soda et al. ..... 399/297
2004/0126149 A1 7/2004 Saito et al. ..... 399/297

FOREIGN PATENT DOCUMENTS

JP 09-44007 2/1997
JP 2003-323062 A 11/2003

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes a first image bearing member, a movable second image bearing member, a charging device and a voltage applying device. A toner image is transferred from the first image bearing member to the second image bearing member at a first transfer portion, and the toner image is transferred from the second image bearing member to a transfer material at a second transfer portion. The charging device is opposed to the second image bearing member at a downstream side of the second transfer portion and at an upstream side of the first transfer portion with respect to a moving direction of the second image bearing member. The voltage applying device switches a DC voltage from a first voltage to a second voltage which is opposite in polarity to the first voltage. The switching from the first voltage to the second voltage is executed at a predetermined number of transfers of the toner image from the second image bearing member to the transfer material, and the predetermined number varies depending on an image forming condition.

9 Claims, 6 Drawing Sheets

PROCESSING AMONG FULL COLOR PAGES

PROCESSING AMONG MONOCOLOR PAGES

IMAGE FORMING APPARATUS USING AN ELECTROPHOTOGRAPHIC PROCESS

BACKGROUND OF THE INVENTION

1. Field of the Invention

The present invention relates to an image forming apparatus utilizing an electrophotographic process.

2. Related Background Art

In a color image forming apparatus utilizing an electrophotographic process, there is known an apparatus utilizing an intermediate transfer method in which a toner image formed on a photosensitive drum is once transferred onto an intermediate transfer member, and plural toner images superposed on the intermediate transfer member are collectively secondarily transferred onto a transfer material.

Also, for recovering so-called transfer residual toner (also called "secondary transfer residual toner") remaining on the intermediate transfer member after the transfer of the toner images therefrom onto the transfer material, there is known a method of charging the secondary transfer residual toner in a polarity opposite to that of the toner by a roller member or the like opposed to the intermediate transfer member, and returning the secondary transfer residual toner by transfer thereof onto the photosensitive drum while executing primary transfer of the toner image from the photosensitive drum.

However, the aforementioned method of returning the secondary transfer residual toner onto the photosensitive drum has a drawback that a part of the secondary transfer residual toner is deposited (adhered) on the roller member for charging such secondary transfer residual toner in the polarity opposite to that of the toner, and such roller member becomes incapable of charging the secondary transfer residual toner in the desired polarity, depending on the amount of such deposition (adherence).

SUMMARY OF THE INVENTION

The present invention, made in consideration of the aforementioned drawback, has an object of providing an image forming apparatus capable of removing a deposited toner sticking to charging means, which charges a secondary transfer residual toner remaining on an intermediate transfer member after the secondary transfer of a toner image onto a transfer material, with a voltage of a predetermined polarity, at a suitable timing corresponding to a deposited amount thereby securely cleaning the residual toner remaining on the intermediate transfer member.

Another object of the present invention is to provide an image forming apparatus including a a first image bearing member for bearing a toner image, a a movable second image bearing member, charging charging means which charges a toner on the second image bearing member, and voltage voltage applying means which applies a voltage to the charging means. The wherein the toner image is transferred from the first image bearing member to the second image bearing member at a first transfer portion. The the toner image is transferred from the second image bearing member to a transfer material at a second transfer portion. The charging means is opposed to the second image bearing member at a downstream side of the second transfer portion and at an upstream side of the first transfer portion with respect to a moving direction of the second image bearing member. The the voltage applying means switches a DC voltage from a first voltage to a second voltage which is opposite in polarity to the first voltage. The the switching from the first voltage to the second voltage is executed at every predetermined number of transfers of the toner image from the second image bearing member to the transfer material.

DESCRIPTION OF THE PREFERRED EMBODIMENTS

In the following, an image forming apparatus of the present invention will be explained with reference to the accompanying drawings.

<First Embodiment>

Figure 1:
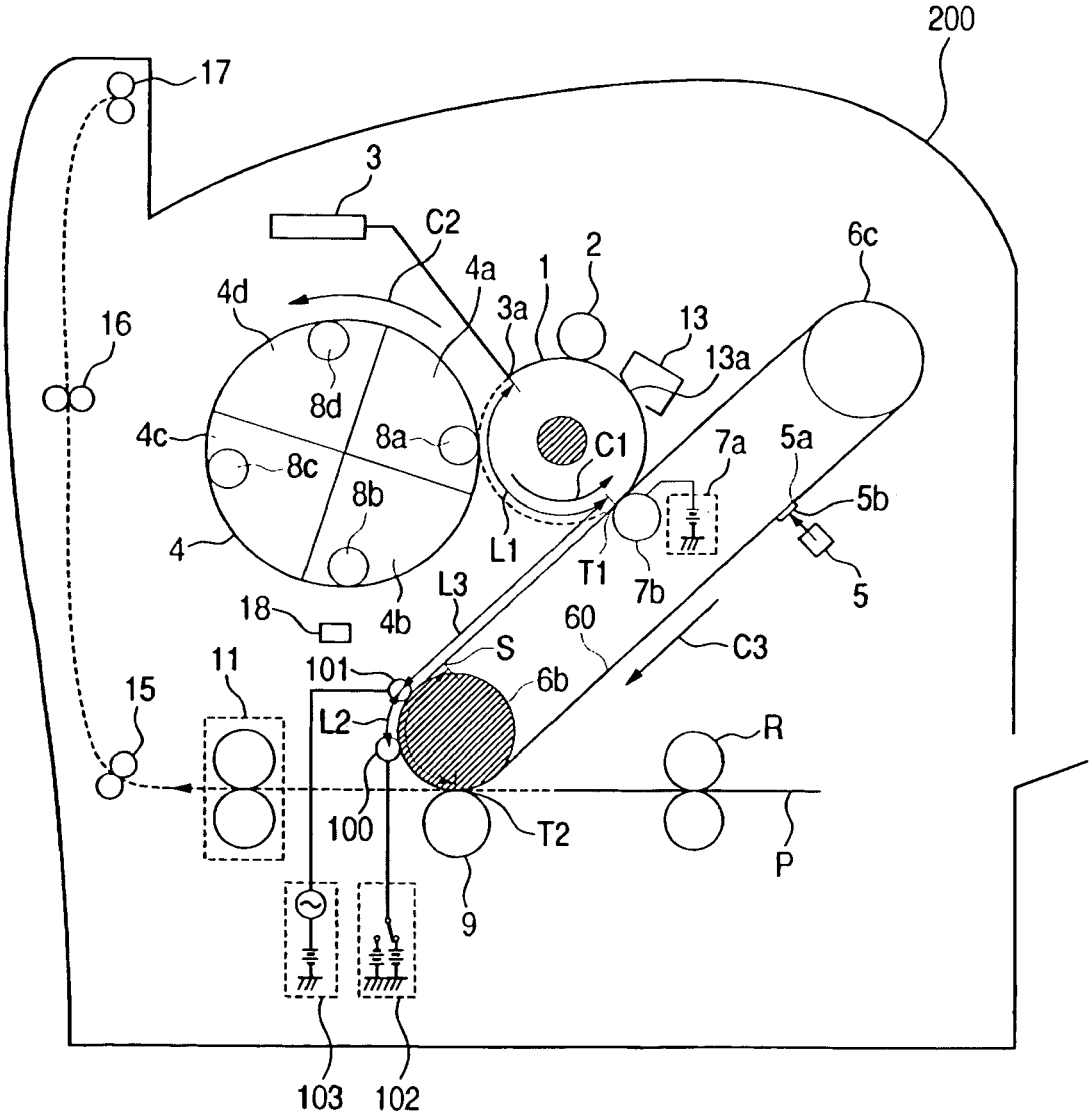
FIG. 1 is a cross-sectional view showing the entire configuration of an image forming apparatus.

FIG. 1 is a cross-sectional view showing the entire configuration of an image forming apparatus 200.

The image forming apparatus 200 shown in FIG. 1 is a color image forming apparatus of so-called intermediate transfer type, in which toner image of plural colors are superposed by successive primary transfers on an intermediate transfer belt 60 and are then collectively primary transferred onto a transfer material P.

A photosensitive drum 1 is constituted of coating an external periphery of a metal core such as of aluminum with an organic photoconductor (OPC) or a photoconductive material such as a-Si, CdS or Se. The photosensitive drum 1 is rotated by an unrepresented main motor, in a direction C1 with a peripheral speed V (hereinafter called process speed).

A primary charging roller 2 charges the surface of the photosensitive drum 1 at a predetermined potential. An exposure apparatus 3, for forming a latent image on the surface of the photosensitive drum 1, uniformly charged by the primary charging roller, exposes the photosensitive drum 1 in an exposure position 3*a* thereon.

The photosensitive drum 1 can be subjected to a development with developing devices 4*a*–4*d* for supplying toners of mutually different toners, and can bear any one of the toner images of plural colors.

An intermediate transfer belt 60 receives a primary transfer of the toner image formed on the photosensitive drum 1, and is formed by a rubber material such as EPDM, NBR, urethane or silicone rubber, or a resinous material such as PI, PA, PC, PVDF, ETFE, PET, PC/PET or ETFE/PC. In the following description, the intermediate transfer belt 60 is assumed to have a circumferential length L4.

A driving roller 6*b*, rotated by the main motor (not shown), supports the intermediate transfer belt 60 in cooperation with a tension roller 6*c*, and rotates the intermediate transfer belt 60 in a direction C3 with the process speed V.

The intermediate transfer belt 60 is provided with a position detecting mark 5*a* in at least a position in the circumferential direction and on an end in a direction perpendicular to the circumferential direction.

An intermediate transfer belt position sensor 5 is constituted of a light emitting element and a light receiving element, and judges whether the position detecting mark has passed, by receiving, with light receiving element, the light emitted from the light emitting element and reflected by the intermediate transfer belt 60.

T1 indicates a contact portion between the photosensitive drum 1 and the intermediate transfer belt 60, namely a primary transfer portion.

L1 indicates a counterclockwise distance from the exposure position 3*a* of the photosensitive drum 1 to the primary transfer portion T1, and S indicates a position, on the intermediate transfer belt 60, of a distance L1 in the upstream side from the primary transfer portion T1.

A primary transfer roller 7*b*, having a conductive sponge layer on a shaft, is in contact with the photosensitive drum 1 across the intermediate transfer belt 60.

An intermediate transfer belt cleaning auxiliary roller 100 is rotated by the intermediate transfer belt 60 with a peripheral speed thereof, and has a circumferential length L5.

An intermediate transfer belt cleaning roller 101 is rotated by the intermediate transfer belt 60 with a peripheral speed thereof, and has a circumferential length L6.

The intermediate transfer belt cleaning auxiliary roller 100 and the intermediate transfer belt cleaning roller 101 have a mechanism for being contacted with or separated from the intermediate transfer belt 60 by switching a solenoid or the like to an on-state or to an off-state.

An auxiliary high voltage source 102 supplies the intermediate transfer belt cleaning auxiliary roller 100 with a DC voltage, and a high voltage source 103 supplies the intermediate transfer belt cleaning roller 101 with a voltage formed by superposing a DC voltage and an AC voltage.

The driving roller 6*b* is used as a counter electrode to the intermediate transfer belt cleaning auxiliary roller 100 and the intermediate transfer belt cleaning roller 101 to increase a charging efficiency in charging a toner, which is not transferred in the secondary transfer portion T2 to the transfer material P, but remains on the intermediate transfer belt 60.

L2 indicates a distance of the intermediate transfer belt cleaning auxiliary roller 100 and the intermediate transfer belt cleaning roller 101 on the intermediate transfer belt 60.

L3 indicates a distance between the intermediate transfer belt cleaning auxiliary roller 100 and the primary transfer roller 7*b* on the intermediate transfer belt 60.

In case the image forming apparatus 200 has a maximum image length Lmax, components of the image forming apparatus 200 have to be so constructed as to satisfy the following relation (1):

$$L5<L4-L\max \quad (1)$$

wherein L5 is the circumferential length of the intermediate transfer belt cleaning auxiliary roller 100 and L4 indicates the circumferential length of the intermediate transfer belt 60.

In a configuration meeting the relation (1), an image formation interval (interval between a rear end of a preceding image and a leading end of a succeeding image) at the image formation of the maximum size becomes longer than the circumferential length L5 of the intermediate transfer belt cleaning auxiliary roller 100.

Also in a configuration meeting the relation (1), a distance on the intermediate transfer belt required for spitting the toner accumulated on the intermediate transfer belt cleaning auxiliary roller 100 can be made smaller than the image formation interval.

In the following, a control configuration of the image forming apparatus 200 will be explained with reference to FIG. 2.

Figure 2:
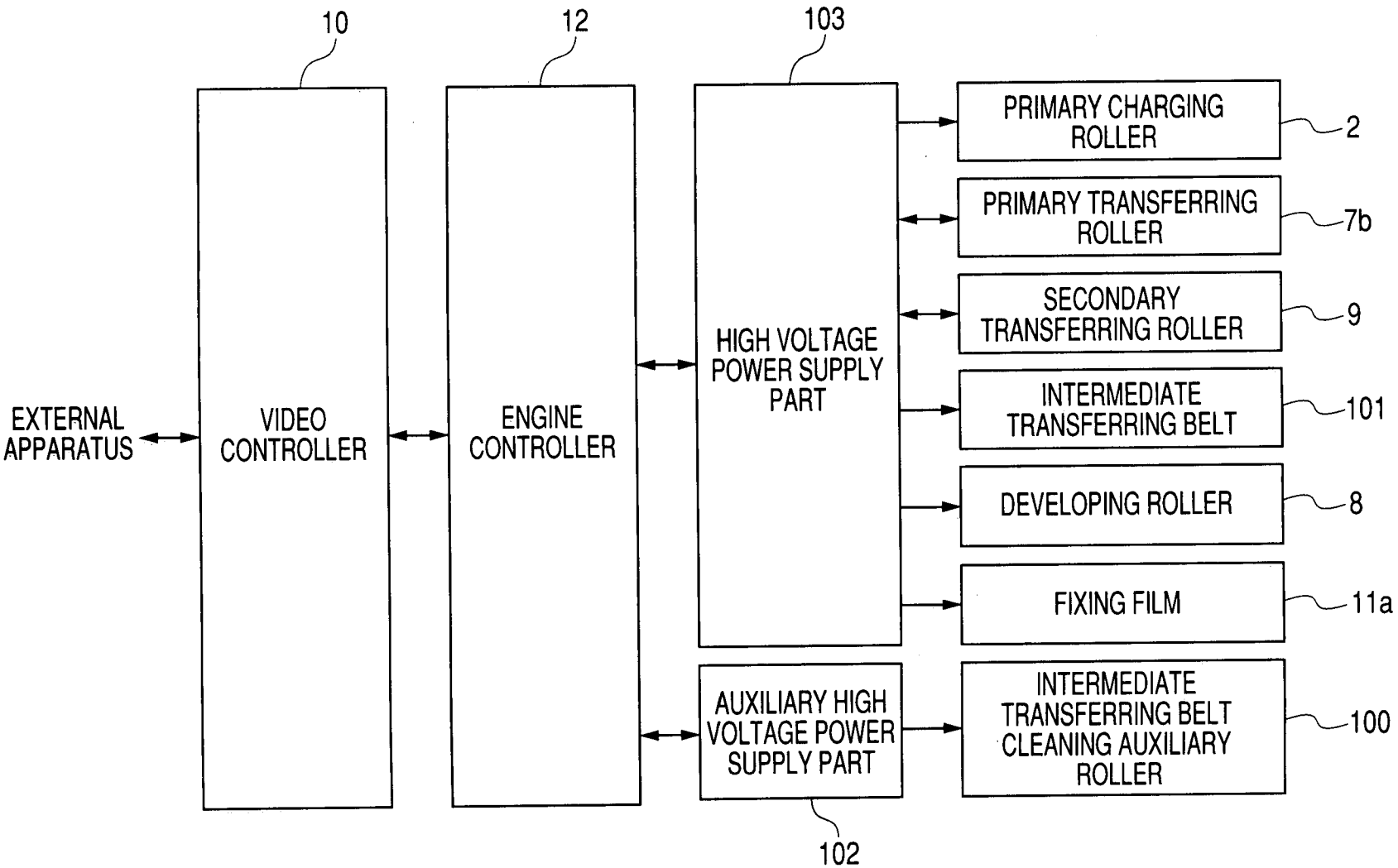
FIG. 2 is a block diagram showing a control configuration of an image forming apparatus 200.

FIG. 2 is a block diagram showing the control configuration of the image forming apparatus 200.

A video controller 10 receives data relating to an image to be formed on the transfer material P and information on image forming conditions such as the type of the transfer material P, from an external apparatus such as a host computer.

An engine controller 12 controls various portions of the image forming apparatus 200, according to a print instruction from the video controller.

The engine controller 12 also controls the high voltage source 103 capable of feeding a DC voltage, an AC voltage or a superposed voltage thereof, to the primary charging roller 2, the primary transfer roller 7*b*, the secondary transfer roller 9, the intermediate transfer belt cleaning roller 101, the developing roller 8 (rollers 8*a*, 8*b*, 8*c*, 8*d*), the fixing film 11*a*, etc.

The engine controller 12 also controls an auxiliary high voltage source 102 for applying a DC voltage to the intermediate transfer belt cleaning auxiliary roller 100, and is capable of applying several DC voltages.

Now, reference is made again to FIG. 1 for explaining a color image forming operation of the image forming apparatus 200 of the aforementioned configuration.

The engine controller 12, after a preparatory operation for charging the photosensitive drum 1 to a predetermined potential (for example −600 V) by the primary charging roller 2, starts an exposure by the exposure apparatus 3 with a yellow image signal constituting a first color, in response to a detection of the position detecting mark 5*a* on the intermediate transfer belt 60 by the intermediate transfer belt position sensor 5.

After the start of the exposure with yellow image signal by the exposure apparatus 3, the engine controller 12 further rotates the photosensitive drum 1 in the direction C1.

Then the engine controller 12 rotates a developing rotary 4 in a direction C2, in such a manner that, among the developing apparatuses 4*a*, 4*b*, 4*c* and 4*d*, a developing apparatus 4*a* containing a yellow toner is opposed to the photosensitive drum 1.

Then, in response to the arrival of the yellow image signal at a developing position (opposed position of the photosensitive drum 1 and the developing roller 8*a*), the engine controller 12 applies a bias voltage to the developing roller 8*a* thereby developing the electrostatic latent image with the toner.

Then, the engine controller 12 further rotates the photosensitive drum 1 in the direction C1 to move a toner image formed with the yellow toner to the primary transfer portion T1, and applies a positive bias voltage (for example 1.0 kV) from a primary transfer source 7*a*, utilizing the metal core of the photosensitive drum 1 as a counter electrode, in order to cause a primary transfer of the toner image from the photosensitive drum 1 to the intermediate transfer belt 60.

In the primary transfer portion T1, as will be explained later, the toner image is primary transferred from the photosensitive drum 1 and, at the same time, the positively charged toner on the intermediate transfer belt 60 is transferred onto the photosensitive drum 1 and recovered by a cleaner 13, whereby the residual toner is eliminated.

When the development of the yellow toner image is completed after a time L/V (L being a length of the formed image and V being peripheral speed of photosensitive drum 1) from the arrival of the leading end of the image at the developing position, the engine controller 12 rotates the developing rotary 4 counterclockwise to place the developing apparatus 4*b*, containing a magenta toner to be superposed next, in a position opposed to the photosensitive drum 1.

Thereafter, the engine controller 12 repeats operations similar to those for the yellow toner for magenta toner, cyan toner and black toner, thereby forming a color toner image formed by superposed toner images of plural colors on the intermediate transfer belt 60.

The engine controller 12 matches the leading ends of the toner images of the respective colors on the intermediate transfer belt 60 by forming the latent image of each color on the photosensitive drum 1 at a timing when the optical sensor 5 detects (hereinafter referred to as top detection) passing of the position detecting mark 5*a* through the detecting portion 5*b*.

After the toner images of four colors are transferred onto the intermediate transfer belt 60, the engine controller 12 conveys the transfer material P from registration rollers R in synchronization with the movement of the intermediate transfer belt 60.

Also the engine controller 12 applies a positive bias (voltage) from the high voltage source 103 to a secondary transfer roller 9 of a similar configuration as the primary transfer roller 7*b*, utilizing the driving roller 6*b* as a counter electrode, thereby transferring the toner images of four colors on the intermediate transfer belt 60 collectively onto the transfer material P.

The engine controller 12 also conveys the color toner image, transferred onto the transfer material P at the secondary transfer portion T2, to the fixing apparatus 11 and causes the fixing apparatus 11 to heat and pressurize the toner image thereby achieving fused fixation onto the transfer material P. Furthermore, the engine controller 12 conveys the transfer material, after passing the fixing apparatus 11, by sheet discharge rollers 15, 16 and 17 thereby discharging the transfer material P from the image forming apparatus 200.

The toner images on the intermediate transfer belt 60 are transferred collectively onto the transfer material P in the secondary transfer portion T2, but the toner images on the intermediate transfer belt 60 are not totally transferred onto the transfer material P and partly remain on the intermediate transfer belt 60.

Therefore, it becomes necessary, in order to prevent an image defect, to execute cleaning of the toner which is not transferred at the secondary transfer but remains on the intermediate transfer belt 60 (such toner being hereinafter called secondary transfer residual toner).

In the following, there will be explained a step of cleaning the toner remaining on the intermediate transfer belt 60 (such step being hereinafter called a secondary transfer residual toner eliminating step). The image forming apparatus 200 shown in FIG. 1 is provided with an intermediate transfer belt cleaning roller 101 and an intermediate transfer belt cleaning auxiliary roller 100 for clean the secondary transfer residual toner.

It is also possible to execute a secondary transfer residual toner eliminating step solely by the intermediate transfer belt cleaning roller 101 which receives an alternating voltage of positive polarity. However, such alternating voltage of positive polarity alone may cause scattering of the toner of a limited charge amount. The invention is intended to prevent the scattering of the toner and to improve the charging property.

When the secondary transfer residual toner passes the intermediate transfer belt cleaning auxiliary roller 100, the engine controller 12 applies a positive DC voltage (for example 1.5 kV) thereto from the auxiliary high voltage source 102.

Thus, secondary transfer residual toner is given a positive charge. The secondary transfer residual toner having the positive charge provided by the intermediate transfer belt cleaning auxiliary roller 100, though being not uniform in the charge amount in the individual toner particles, can be charged under suppression of toner scattering owing to such positive charge, when an alternating voltage of positive polarity is applied later by the intermediate transfer belt cleaning roller 101.

When the secondary transfer residual toner having the positive charge passes the intermediate transfer belt cleaning roller 101, the engine controller 12 applies an alternating voltage of positive polarity to the intermediate transfer belt cleaning roller 101 from the high voltage source 103.

Figure 6A:
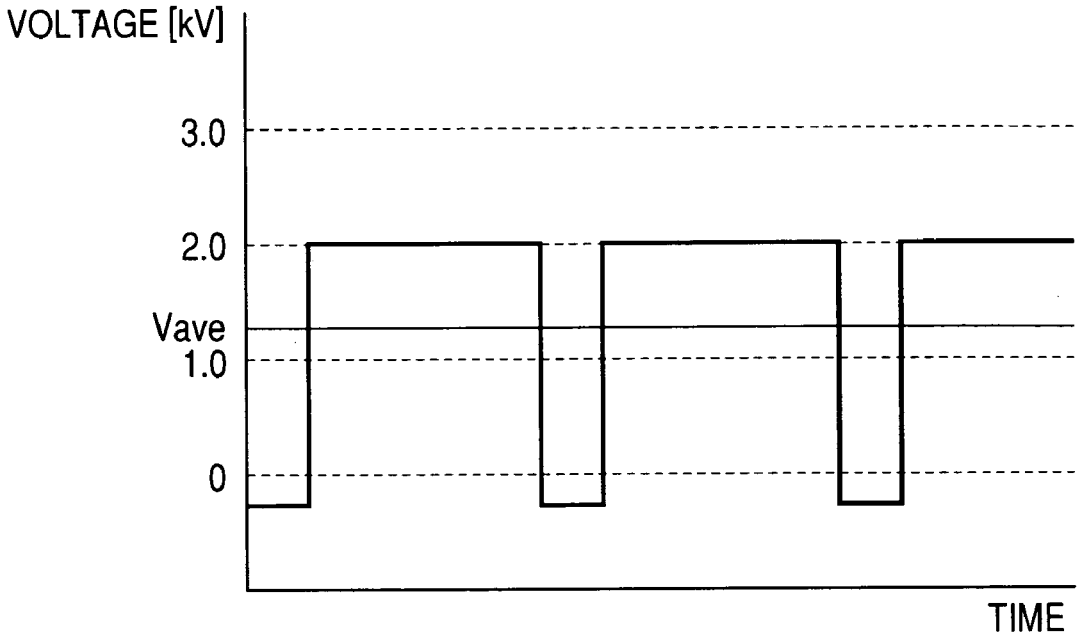
FIGS. 6A and 6B are charts showing voltages applied by a high voltage source 103 to an intermediate transfer belt cleaning roller 101.

FIG. 6A shows the voltage applied from the high voltage source 103 to the intermediate transfer belt cleaning roller 101 for returning the secondary transfer residual toner.

The secondary transfer residual toner is charged positively by the intermediate transfer belt cleaning auxiliary roller 100, but is not uniform in the charge amounts of the individual toner particles. Therefore, the charge amounts of the toner particles are made uniform by applying an alternating voltage in which a positive voltage of 2.0 kV and a negative voltage of −250 V are alternated as shown in FIG. 6A (time-averaged voltage $V_{ave}$=1.3 kV). Depending upon the environment of the image forming apparatus 200, it may be desirable to vary the positive and negative voltages mentioned above (for example so as to change $V_{ave}$ within a range of 1.0 to 1.5 kV).

Thus, by the application of the AC voltage by the intermediate transfer belt cleaning roller 101, the charge amounts of the individual toner particles are made uniform while the secondary transfer residual toner maintains a positive electric polarity.

The secondary transfer residual toner, made uniform in the positive polarity by the intermediate transfer belt cleaning roller 101, is thereafter returned onto the photosensitive drum 1 upon passing the primary transfer portion T1.

More specifically, the engine controller 12 applies a positive bias (voltage) from the high voltage source 103 to the primary transfer roller 7*b*, whereby, simultaneous with a primary transfer of a yellow toner image which is a first color of a next page from the photosensitive drum 1 to the intermediate transfer belt 60, the secondary transfer residual toner is electrostatically transferred to the positively charged surface of the photosensitive drum 1.

Thereafter, the secondary transfer residual toner, transferred onto the photosensitive drum 1, is recovered by the cleaner 13, whereby the eliminating step for the secondary transfer residual toner on the intermediate transfer belt 60 is completed.

In the following, there will be explained recovery of the toner deposited on the intermediate transfer belt cleaning auxiliary roller 100.

The engine controller 12 applies the positive DC voltage to the intermediate transfer belt cleaning auxiliary roller 100 to positively charge the secondary transfer residual toner, but the toner of negative polarity, that cannot be fully charged, is deposited on the intermediate transfer belt cleaning auxiliary roller 100.

Therefore, in case of a continuous image formation over plural pages, the deposited toner is accumulated on the surface of the intermediate transfer belt cleaning auxiliary roller 100. Such toner accumulation gradually deteriorates the charging property of the intermediate transfer belt cleaning auxiliary roller 100 for charging the secondary transfer residual toner, thereby resulting in an insufficient cleaning of the intermediate transfer belt 60 by a deficient charging or a dropping of the toner from the intermediate transfer belt 60 thereby smearing the interior of the apparatus or the transfer material P.

Therefore, the engine controller 12 has to execute an elimination of the deposited toner (hereinafter called a deposited toner elimination step) in such a manner that the amount of the deposited toner does not exceed a predetermined amount.

In the following, the deposited toner elimination step will be explained with reference to FIG. 2.

In case of spitting the toner deposited on the intermediate transfer belt cleaning auxiliary roller 100 onto the intermediate transfer belt 60, the engine controller 12 switches the voltage applied by the auxiliary high voltage source 102 to the intermediate transfer belt 60 from an ordinary positive bias voltage to a negative bias voltage (hereinafter called a discharge bias, for example −1.5 kV), thereby spitting the deposited toner onto the intermediate transfer belt 60, for a period corresponding to a rotation period of the intermediate transfer belt cleaning auxiliary roller 100.

Also, when the toner spit from the intermediate transfer belt cleaning auxiliary roller 100 onto the intermediate transfer belt 60 (hereinafter called spit toner) passes the nip portion of the intermediate transfer belt cleaning auxiliary roller 100 and the intermediate transfer belt cleaning roller 101, the engine controller 12 applies an alternating voltage of positive polarity from the high voltage source 103 to the intermediate transfer belt cleaning roller 101, thereby providing the spit toner with a positive charge.

Figure 6B:
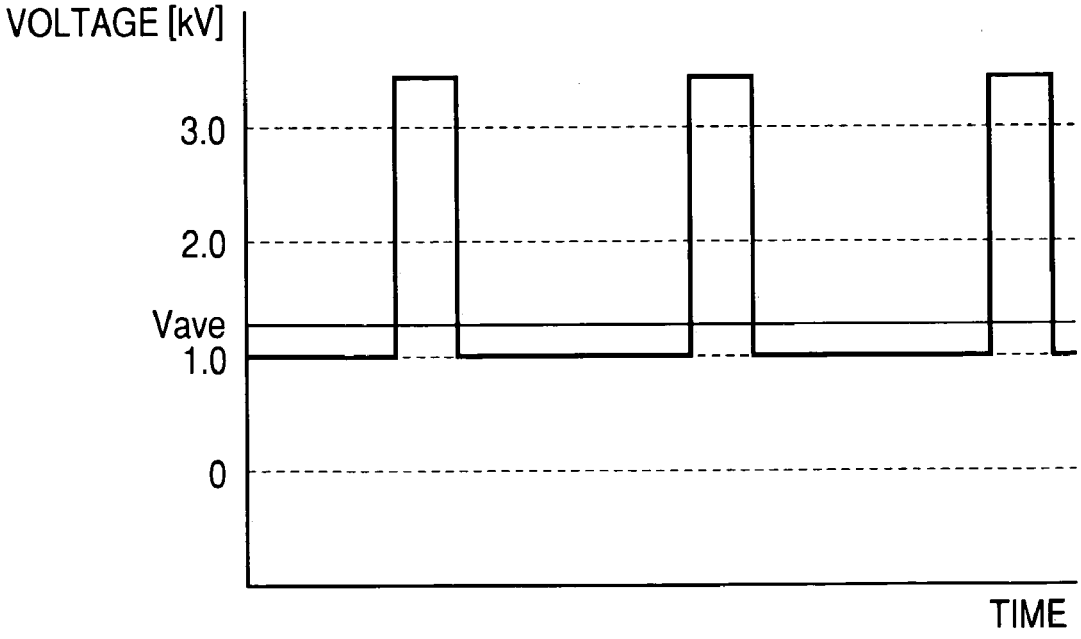

Since the spit toner is negatively charged toner spit from the intermediate transfer belt cleaning auxiliary roller 100, it has to be charged in a predetermined positive potential by the intermediate transfer belt cleaning roller 101, in order to cause a transfer from the intermediate transfer belt 60 to the photosensitive drum 1. Therefore, a voltage shown in FIG. 6B is adopted as a voltage to be applied to the intermediate transfer belt cleaning roller 101 at the recovery of the spit toner. In contrast to the case shown in FIG. 6A, the voltage applied to the toner in FIG. 6B has a larger maximum value and is an alternating voltage of 1.0 kV and 3.5 kV.

The application of a voltage of such a large maximum value brings the spit toner of negative polarity to a predetermined positive polarity. The voltage shown in FIG. 6B has an average value $V_{ave}$, the same as that of the voltage shown in FIG. 6A. This is to prevent a difference in the average voltage applied from the intermediate transfer belt cleaning roller 101 to the intermediate transfer belt 60, resulting in a difference in the potential thereof, and thereby causing a change in the image density, etc., at the image formation.

Since the intermediate transfer belt cleaning roller 101 applies an alternating voltage to the spit toner, the individual particles of the spit toner have an approximately uniform charge amount.

The spit toner, made uniform in the positive polarity by the intermediate transfer belt cleaning roller 101, is returned thereafter onto the photosensitive drum 1 upon passing the primary transfer portion T1.

More specifically, the engine controller 12 applies a positive bias (voltage) from the high voltage source 103 to the primary transfer roller 7*b*, whereby the spit toner is electrostatically transferred onto the negatively charged surface of the photosensitive drum 1.

Then the spit toner transferred onto the photosensitive drum 1 is recovered by the cleaner 13, whereby the deposited toner eliminating step for the intermediate transfer belt 60 is completed.

In the foregoing, there has been explained an operation of forming a full-color image on the transfer material P.

In the following there will be explained, with reference to FIG. 3, an image forming step, a secondary transfer residual toner eliminating step and a deposited toner eliminating step between pages in a full-color image forming operation.

Figure 3:
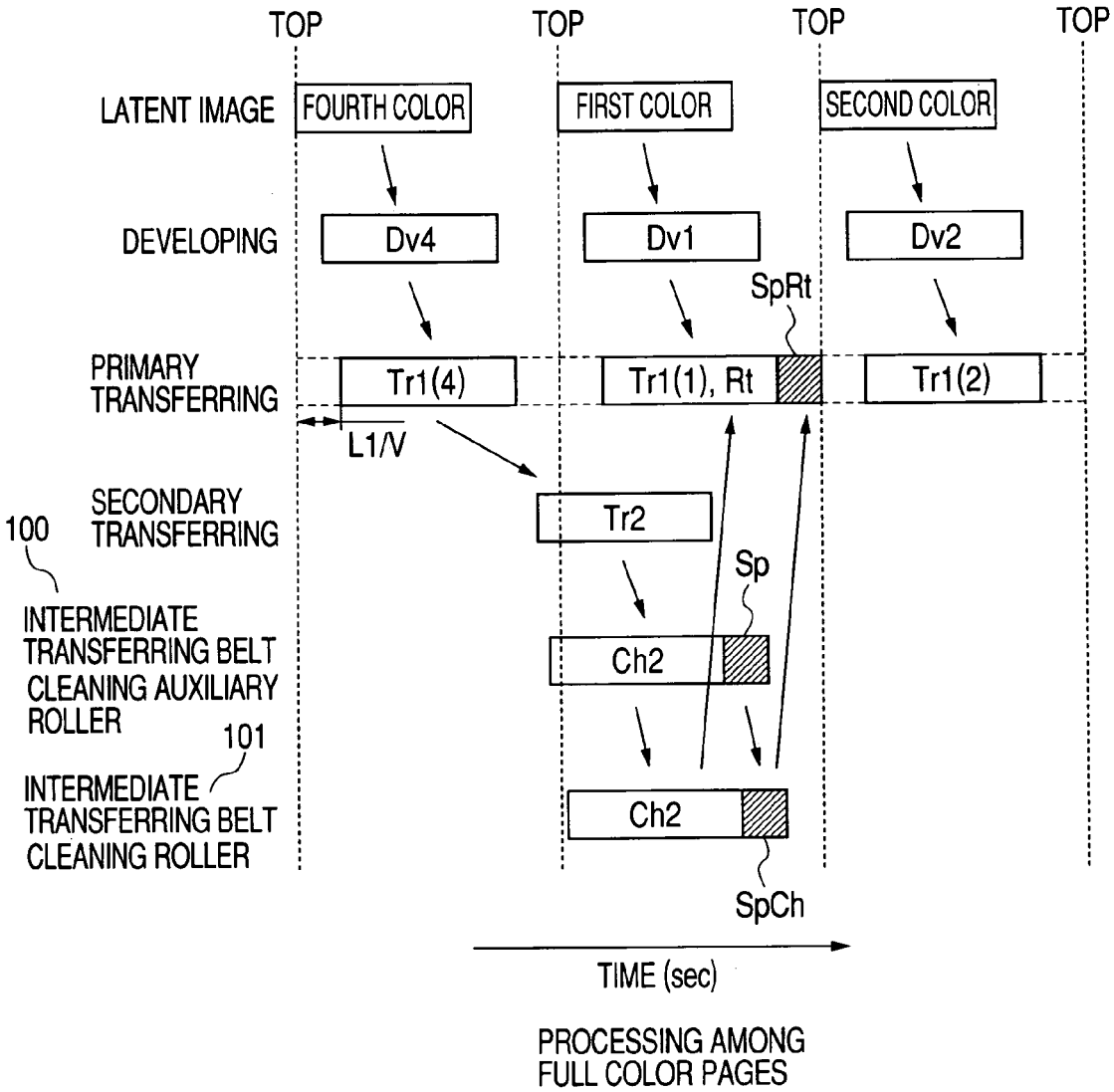
FIG. 3 is a timing chart showing an operation of forming a color image on a transfer material P.

FIG. 3 is a timing chart showing an operation of forming a color image on the transfer material P.

In FIG. 3, TOP indicates a timing (top detection timing) at which the optical sensor 5 detects top detection of the passing of the position detecting mark 5*a* through the detecting portion 5*b*.

Also, Dv1–4 indicate periods of applying the developing bias (voltage) to the developing rollers 8*a*–8*d* for developing images of first to fourth colors.

Also Tr(1)–Tr(4) indicate periods of application of the primary transfer bias (voltage) from the primary transfer power source 7*a* to the primary transfer roller 7*b* for primary transfers of the toner images of first to fourth colors, developed on the photosensitive drum 1, onto the intermediate transfer belt 60.

Further, Ch2 indicates a charging of the secondary transfer residual toner by the intermediate transfer belt cleaning roller 101 and the intermediate transfer belt cleaning auxiliary roller 100, and Rt indicates a returning of the secondary transfer residual toner onto the photosensitive drum 1 by the primary transfer roller 7*b*.

Also, Sp indicates a spitting of the toner deposited on the intermediate transfer belt 60 by the intermediate transfer belt cleaning auxiliary roller 100; SpCh indicates a charging of the spit toner; and SpRt indicates a returning of the spit toner to the photosensitive drum 1 by the primary transfer roller 7*b*. Also, arrows in FIG. 3 indicate positions of the toner in the image forming apparatus 200 (primary transfer portion T1, secondary transfer portion T2, etc.).

In case the deposited toner eliminating step is executed during a continuous image formation of plural pages, the toner has to be spit out in a non-image area which is an interval (image formation interval) between a trailing end of a preceding image and a leading end of a succeeding image.

Since the image forming apparatus 200 is so constructed as to satisfy the aforementioned relation (1), there can be avoided an overflow of the spit toner from the non-image area (image formation interval) between a trailing end of a preceding image and a leading end of a succeeding image, thereby being transferred onto the image of the first color and being insufficiently recovered onto the photosensitive drum 1 or resulting in an insufficient primary transfer of the image of the second color.

In the following, there will be explained, with reference to FIGS. 4 and 5, an image forming step, a secondary transfer residual toner eliminating step and a deposited toner eliminating step in a monochromatic image formation in which a monochromatic toner image is transferred onto the transfer material P.

Figure 4:
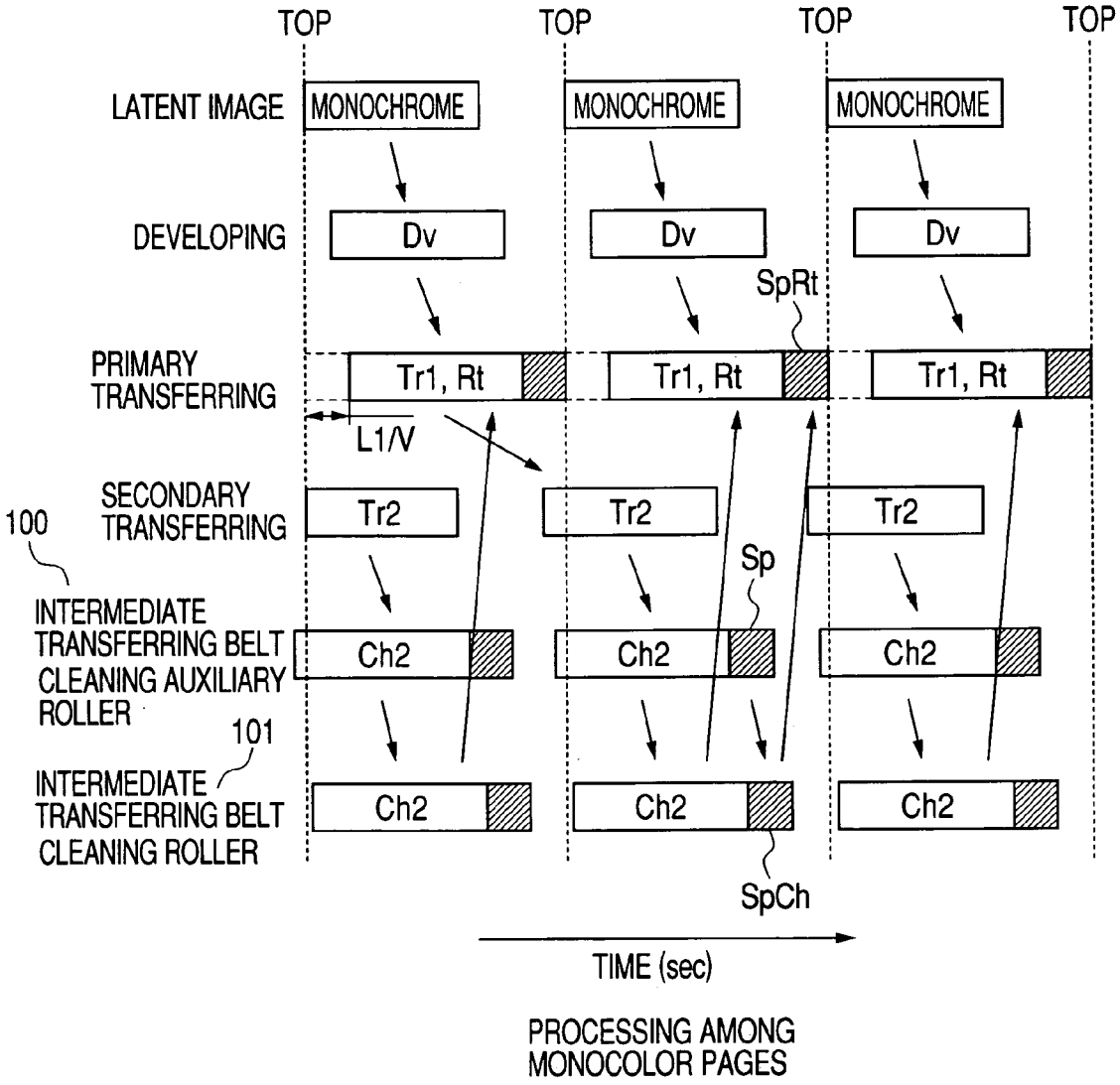
FIG. 4 is a timing chart showing an image forming step, a secondary transfer residual toner eliminating step and a deposited toner eliminating step, in a monochromatic printing constituting a comparative example of the first embodiment.
Figure 5:
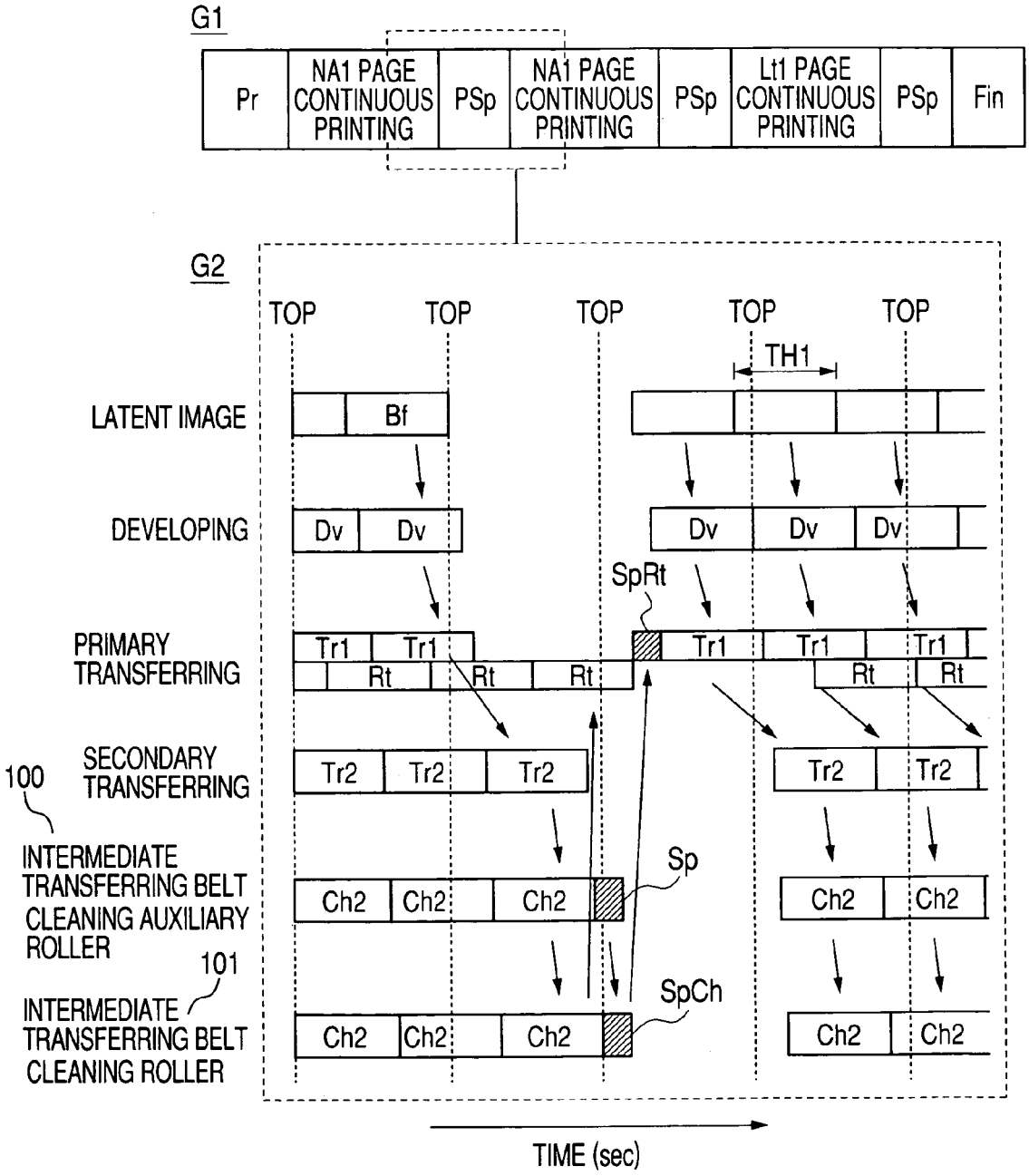
FIG. 5 is a timing chart showing an image forming step, a secondary transfer residual toner eliminating step and a deposited toner eliminating step in a first embodiment.

FIG. 5 is a timing chart showing an image forming step, a secondary transfer residual toner eliminating step and a deposited toner eliminating step in a monochromatic image formation in the first embodiment, and FIG. 4 is a timing chart showing an image forming step, a secondary transfer residual toner eliminating step and a deposited toner eliminating step in a comparative example to FIG. 5.

At first, the comparative example will be explained with reference to FIG. 4, prior to the explanation of the first embodiment.

In FIG. 3, there has been explained an operation of forming a full-color toner image on the transfer material P, in which the secondary transfer is executed after the toner images of four colors are superposed on the intermediate transfer belt 60. Therefore, the engine controller 12 executes the secondary transfer of the toner images, and also executes the secondary transfer residual toner eliminating step and the deposited toner eliminating step for every 4 turns of the intermediate transfer belt 60.

The case shown in FIG. 4 executes the secondary transfer residual toner eliminating step and the deposited toner eliminating step for every secondary transfer, but, different from the case of FIG. 3, the printing is a monochromatic printing for forming a monochromatic toner image in which the secondary transfer residual toner eliminating step and the deposited toner eliminating step are executed for every turn of the intermediate transfer belt 60.

In FIG. 4, the secondary transfer residual toner eliminating step is similar to that in the full-color printing mode, but a period of recovering the secondary transfer residual toner corresponds to a period of primary transfer of a next page. Also the deposited toner eliminating step corresponds to a period between the primary transfers of the next page and a page after next.

Referring to FIG. 4, a print sequence for forming a monochromatic image on the transfer material P includes at least the following steps, namely a printing step constituted of an image forming step, a secondary transfer residual toner eliminating step and a deposited toner eliminating step, a pre-rotation step and a post-rotation step for cleaning the intermediate transfer belt 60 before and after the printing step.

In the following description, there are assumed conditions of a process speed V of 120 mm/s, a circumferential length L4 of the intermediate transfer belt of 450.0 mm, a maximum image length $L_{max}$ of 300.0 mm, a circumferential length L5 of the intermediate transfer belt cleaning auxiliary roller of 36.0 mm, a distance L2 between the intermediate transfer belt cleaning auxiliary roller 100 and the intermediate transfer belt cleaning roller 101 of 12.0 mm, and a distance L3 from the intermediate transfer belt cleaning roller 101 to the primary transfer portion T1 of 84.0 mm.

The engine controller 12 applies a positive bias voltage for positively charging the secondary transfer residual toner from the auxiliary high voltage source 102 to the intermediate transfer belt cleaning auxiliary roller 100 in the deposited toner eliminating step to be executed between the images of plural pages, and then applies a negative spitting bias during a roller cycle period (L5/V)=0.300 s.

Also the engine controller 12 applies, from the high voltage source 103 to the intermediate transfer belt cleaning roller 101 in the deposited toner eliminating step between the pages, a bias for charging the spit toner (cf. FIG. 6B) in a period of L2/V=0.100 s after the spitting period of the intermediate transfer belt cleaning auxiliary roller 100.

Also in a full-color printing, the spit toner passes the first transfer portion T1 in an initial time of 0.300 s within a period of($L4-L_{max}$)/V=1.250 s after the end of the secondary transfer of the preceding page and the end of the primary transfer for the first color in the succeeding page, and before the start of the primary transfer for the second color. On the other hand, in the monochromatic printing shown in FIG. 4, toner passes through in an initial time of 0.300 s within a period of 1.250 s after the end of the primary transfer of the succeeding page, and before the start of the primary transfer of a page after next. Therefore, a bias for returning the spit toner onto the photosensitive drum 1 is applied to the primary transfer roller 7*b* in the respective periods.

As explained in the foregoing, the deposited toner eliminating step executed for every page, both in the full-color image formation and in the monochromatic image formation, allows suppression of the amount of the deposited toner accumulated in the intermediate transfer belt cleaning auxiliary roller 100 within a predetermined amount. Thus, a defective cleaning of the intermediate transfer belt 60 resulting from an insufficient charging of the secondary transfer residual toner or a dropping of the toner from the intermediate transfer belt 60 can be avoided. Accordingly, a smear of the interior of the apparatus or of the transfer material P can be avoided, thus ensuring the provision of a high quality image.

The full-color printing is executed by superposing toner images of four colors in succession from the photosensitive drum 1 onto the intermediate transfer belt 60, and by a secondary transfer of these images onto the transfer material P. The monochromatic printing is executed by a primary transfer of a toner of a color from the photosensitive drum 1 onto the intermediate transfer belt 60 and by a secondary transfer of such image onto the transfer material P.

Therefore, although the amount of the secondary transfer residual toner is variable depending on a coverage rate of the image to be printed, it is smaller in the monochromatic printing since the average amount of toner secondarily transferred per page is smaller in the monochromatic printing.

Also the amount of the toner deposited on the intermediate transfer belt cleaning auxiliary roller 100 becomes smaller as the amount of the secondary transfer residual toner decreases.

Therefore, in the comparative example shown in FIG. 4, in which the deposited toner eliminating step is executed for every page in the monochromatic printing, the accumulated amount of the deposited toner in such step is smaller in comparison with a case of a full-color printing. Stated differently, the monochromatic printing operation shown in FIG. 4 may involve a waste of an electric power for the bias in the deposited toner eliminating step, in comparison with the full-color printing.

Therefore, the first embodiment executes, in the full-color printing, the deposited toner eliminating step for every secondary transfer of the toner image on the intermediate transfer belt 60, but, in the monochromatic printing, executes the deposited toner eliminating step not for every secondary transfer but at a predetermined timing.

In the following there will be explained, with reference to FIG. 5, an image forming step, a secondary transfer residual toner eliminating step and a deposited toner eliminating step in a monochromatic image formation in the first embodiment.

In FIG. 5, G1 indicates a timing chart showing the flow of an entire print sequence.

In G1, Pr indicates a pre-rotation step, which is a preparatory operation for charging the surface of the photosensitive drum 1 with the primary charging roller 2 under the rotation of the photosensitive drum 1 in order to stabilize the surface potential thereof at a predetermined value, prior to the image formation.

Also in G1, NA1 indicates a number of pages of a continuous image formation (hereinafter referred to as continuous page number) before the deposited toner eliminating step is executed; PSp indicates a deposited toner eliminating step; Lt1 indicates a remaining page number when all the page number in the print sequence is dived by the continuous page number NA1; and Fin indicates a post-rotation step. Thus, G1 is a timing chart of image formation of (NA1+NA1 +Lt1) pages.

Also, G2 is a timing chart showing details of the deposited toner eliminating step in G1, and operations before and after such a step.

In G2, TH1 indicates an interval of start timings of the exposure by the exposure apparatus 3 corresponding to the image signals of the respective pages (hereinafter called page interval) in a continuous printing of plural pages; and Bf indicates a page immediately before the deposited toner eliminating step (hereinafter called a page before spitting). Other symbols are same as those explained in FIG. 4.

In the first embodiment, a print sequence for a full-color printing is the same as explained in FIG. 3, and a sequence for monochromatic printing will be explained in the following.

The engine controller 12 initiates a pre-rotation step Pr in response to a reception of a print signal from the video controller 10 which has received an image signal to be printed from an external apparatus.

Then the engine controller 12 starts a printing operation after the image forming apparatus 200 reaches a stand-by state capable of image formation.

Then the engine controller 12 applies a positive DC voltage (for example 1.5 kV) from the auxiliary high voltage source 102 to the intermediate transfer belt cleaning auxiliary roller 100 until the number of pages of continuous image formation reaches the NA1. Thereafter, the engine controller 12, for executing the deposited toner eliminating step after the secondary transfer of the NA1-th page, applies a negative DC voltage (for example −1.5 kV) from the auxiliary high voltage source 102 to the intermediate transfer belt cleaning auxiliary roller 100.

As explained in the foregoing, the engine controller 12 executes the deposited toner eliminating step PSp after every continuous printing by continuous page number NA1 and also after a continuous printing of the final remaining page number Lt1. Thereafter, the engine controller 12 executes a post-rotation step Fin for shifting the image forming apparatus 200 to a predetermined stand-by state, thereby terminating the print sequence.

In the following, there will be explained timings of application of biases in the deposited toner eliminating step PSp, along a timing chart G2 shown in FIG. 5. The timings of bias application in the image forming step and the secondary transfer residual toner eliminating step in a continuous printing operation are the same as those explained in FIG. 3.

Then the engine controller 12, after the image forming step for the page Bf before spitting, enters a stand-by state for the image forming step of the next page.

Also the engine controller 12 starts the deposited toner eliminating step after the application of the voltage for positively charging the secondary transfer residual toner to the intermediate transfer belt cleaning auxiliary roller 100 for the page BF before spitting (namely after Ch2).

The deposited toner eliminating step is constituted of a step Sp for spitting the deposited toner from the intermediate transfer belt cleaning auxiliary roller 100, a step SpCh for charging the spitted toner by the intermediate transfer belt cleaning roller 101, and a step SpRt for returning the spitted toner from the intermediate transfer belt 60 to the photosensitive drum 1 in the primary transfer portion T1.

In the deposited toner eliminating step, the timings of bias voltage application to the intermediate transfer belt cleaning auxiliary roller 100, the intermediate transfer belt cleaning auxiliary roller 101, and the primary transfer roller 7*b* are the same as in the full-color printing shown in FIG. 3.

After the deposited toner eliminating step, the engine controller 12 re-starts the image forming step of the next page in the stand-by state, thereby repeating the image formation step by the continuous page number NA1.

The latent image formation on the page in the stand-by state can be re-started by executing the primary transfer of the toner image on such stand-by page from the photosensitive drum 1 to the intermediate transfer belt 60 after a timing when the spit toner returning step SpRt is terminated.

More specifically, since the spit toner returning step SpRt may result in a defective primary transfer because of a voltage application different from the voltage for primary transfer of the toner image from the photosensitive drum 1 to the intermediate transfer belt 60, the primary transfer of the re-started page should be executed after the spit toner returning step SpRt is terminated.

Therefore, the latent image formation for the next page in the stand-by state may be started earlier than the completion of the spit toner returning step SpRt of the deposited toner eliminating step.

In the foregoing, there has been explained a process to be executed when the total page number of the print sequence is equal to or larger than the continuous page number NA1. In case the number of pages is less than the continuous page number NA1, the continuous printing operation may be executed for all the pages and the deposited toner eliminating step may be executed after the last page.

As the amount of the deposited toner is smaller in the monochromatic printing than in the full-color printing, a sufficient cleaning effect can be obtained by suitably selecting the continuous page number NA1 even without executing the deposited toner eliminating step for every page.

It is also possible to set the page period TH1 shorter than the rotation period of the intermediate transfer belt 60 thereby increasing a number of pages of image formations per unit time (throughput).

In the following, there will be explained the operation shown in FIG. 5, under conditions of a process speed V of 120 mm/s, a circumferential length L4 of the intermediate transfer belt of 450.0 mm, a maximum image length $L_{max}$ of 300.0 mm, a circumferential length L5 of the intermediate transfer belt cleaning auxiliary roller of 30.0 mm, a distance L1 from the exposure position to the primary transfer portion of 60.0 mm, a distance L2 between the intermediate transfer belt cleaning auxiliary roller 100 and the intermediate transfer belt cleaning roller 101 of 12.0 mm, a distance L3 from the intermediate transfer belt cleaning roller 101 the primary transfer portion T1 of 84.0 mm, a page period TH1 of 3,000 s, and a continuous page number of 20 pages.

The engine controller 12 executes, after the pre-rotation operation, a continuous printing of 20 pages, and, when the latent image formation is completed on the page Bf before the spitting, sets the latent image formation of a next page in a stand-by state.

Then the engine controller 12 starts application of the spitting bias from a timing when the charging of the secondary transfer residual toner of the page Bf before the spitting is terminated, and continues such application for the roller period (L5/V=0.250 s) thereby spitting out the deposited toner.

Also, a positive bias for charging the spit toner is given to the intermediate transfer belt cleaning roller 101 in a period after L2/V=0.100 s from the spitting period in the intermediate transfer belt cleaning auxiliary roller 100. Then, positive bias for returning the spit toner is given to the primary transfer roller 7*b* in a period after L3/V=0.700 s from the spit toner charging period in the intermediate transfer belt cleaning roller 101.

After the end of the application of the positive bias for the spit toner returning to the primary transfer roller 7*b*, the engine controller 12 switches it to a bias for primary transfer, and starts the latent image formation of the next page, which has been in the stand-by state, prior to the end of a time L1/V=0.500 s from such switching.

Thereafter, the engine controller 12 executes a continuous printing of 20 pages with a page period of 3,000 s, and thereafter executes a deposited toner eliminating step again. The continuous page number NA1 is selected as 20 pages with a certain margin, since an experiment with the deposited toner eliminating step executed at every 25 pages resulted in drawbacks, such as a defective cleaning of the intermediate transfer belt 60 by the insufficient charging and a toner dropping, leading to a smear in the interior of the apparatus or on the transfer material P.

As explained in the foregoing, in contrast to the configuration shown in FIG. 4 in which the deposited toner eliminating step is executed for every secondary transfer of the toner image from the intermediate transfer belt 60 to the transfer material P (for every page), the configuration shown in FIG. 5 executes the deposited toner eliminating step for every continuous page number NA1, thereby allowing the waiting time required for executing the deposited toner eliminating step to be reduced.

More specifically, in FIG. 4, based on the rotation period of the intermediate transfer belt 60 of L4/V=3.750 s, the throughput in the full-color printing becomes (60/(3.750×4))=4 ppm and that in the monochromatic printing becomes (60/3.750)=16 ppm.

On the other hand, in FIG. 5, the throughput in the monochromatic printing becomes (60/3,000)=20 ppm, and can thus be made higher than that in the comparative example (a larger number of output pages per unit time).

In the monochromatic printing, a more efficient operation can be executed by varying the NA1 value according to the longitudinal direction of the toner image along the conveying direction thereof. More specifically, the NA1 value is made larger in case of continuously printing a shorter toner image, namely a smaller-sized image, than in a larger-sized image, because the amount of the toner image is different for a same number of transfers.

In the first embodiment, as explained in the foregoing, the deposited toner eliminating step for eliminating the toner deposited on the intermediate transfer belt cleaning auxiliary roller 100 is executed at a suitable timing in the monochromatic printing, so that the intermediate transfer belt 60 can be appropriately cleaned without wasting the electric power by executing the deposited toner eliminating step when the accumulated amount of the deposited toner is low.

Also the throughput can be improved by selecting the page period TH1 shorter than the rotation period of the intermediate transfer belt 60.

<Second Embodiment>

In the following, a second embodiment will be explained.

The image forming apparatus 200 in the second embodiment is the same as that of the first embodiment explained in FIG. 1. The configuration of the image forming apparatus 200 explained in the first embodiment is applicable also to the second embodiment and will not, therefore, be explained further.

Temperature and humidity sensors, for respectively detecting temperature and humidity, are not illustrated but are preferably provided in the vicinity of the intermediate transfer belt cleaning auxiliary belt 100.

A print sequence in the second embodiment includes steps similar to those in the first embodiment, but is different in the method of setting a continuous page number NA1 in the monochromatic printing.

A charge amount held by the toner generally varies depending on temperature/humidity environment.

Also a force which the toner on the photosensitive drum 1 receives at the secondary transfer portion T2 by the secondary transfer bias (voltage) applied to the secondary transfer roller 9 becomes larger as the charge amount of the toner increases.

Further, a toner amount deposited on the intermediate transfer belt cleaning auxiliary roller 100 increases as the secondary transfer residual toner increases.

Based on the foregoing, a change in the temperature/humidity environment causes a change in the amount of the secondary transfer residual toner with a change in the charge amount of the toner, thereby causing a change in the toner amount deposited on the intermediate transfer belt cleaning auxiliary roller.

Therefore, if the continuous page number NA1 is set constant regardless of the temperature/humidity environment so as not to cause a drawback such as an insufficient cleaning even in a temperature/humidity condition inducing a high deposited toner amount, the deposited toner eliminating step is executed with an unnecessarily high frequency in a temperature/humidity environment inducing a low deposited toner amount, whereby the electric power is wasted for the bias application for the deposited toner eliminating step.

Therefore, the second embodiment sets the continuous page number NA1 according to the following method.

At first, a continuous printing operation is executed without executing the deposited toner eliminating step, and a page number at which the drawback such as the insufficient cleaning is experimentally determined in each of different temperature/humidity environments.

Then a continuous page number NA1 for each of plural different environments is stored in a storage portion (not shown) such as a memory provided in the engine controller 12 of the image forming apparatus 200.

The continuous page number NA1 to be stored may be the same as the experimentally determined page number, but is preferably selected smaller than the experimentally determined page number in order to avoid the foregoing drawback.

Then the engine controller 12 refers to the temperature and humidity detected by the temperature/humidity sensor 18 prior to the image formation and reads the continuous page number NA1 corresponding to the detected temperature and humidity, whereby the continuous page number NA1 can be appropriately selected matching the environment.

As specific examples of the continuous page number NA1, for the monochromatic printing, 10 pages for a high temperature/high humidity environment (temperature 30° C. or higher and humidity 80% or higher, hereinafter represented as HH environment), 30 pages for a low temperature/low humidity environment (temperature 15° C. or lower and humidity 10% or lower, hereinafter represented as LL environment), and 20 pages for other environments (hereinafter represented as ordinary environment) are stored in the memory of the engine controller 12.

Based on the temperature and humidity detected by the temperature/humidity sensor 18 in the pre-rotation step, the engine controller 12 judges whether the image forming apparatus 200 is located in an HH environment, an LL environment or an ordinary environment, and sets a continuous page number NA1 according to such environment.

The aforementioned selection of the continuous page number NA1 is based on the following reason.

Experimentally, drawbacks such as a defective cleaning of the intermediate transfer belt 60 caused by an insufficient charging or a dropping of the toner resulting in a smear in the interior of the image forming apparatus 200 or on the transfer material P were observed when the deposited toner eliminating step was executed every 15 pages in the HH environment, every 35 pages in the LL environment, or every 25 pages in the ordinary environment. Thus, the set values were determined with margins in order to securely avoid such drawbacks.

In the second embodiment, as explained in the foregoing, the continuous page number, which indicates an interval of pages for executing the deposited toner eliminating step, is selected according to the temperature/humidity environment, whereby it is rendered possible, in a monochromatic printing in a temperature/humidity environment inducing a low deposited toner amount, to prevent an excessive electric power consumption and a loss in the throughput, resulting from execution of the deposited toner eliminating step with an unnecessarily high frequency.

In the second embodiment, the environment of the image forming apparatus 200 has been explained to be detected by the temperature/humidity sensor, but it is also possible to detect the environment by a current sensor which applies a predetermined voltage from the high voltage source 103 to the secondary transfer roller 9 prior to the image formation and detects a current flowing in the secondary transfer roller 9.

This is based on a fact that the resistance of the secondary transfer roller 9 varies depending on the environment (temperature/humidity), and, for example, a high temperature/high humidity environment or a low temperature/low humidity environment can be identified respectively when the current detected by the current sensor is higher or lower than a predetermined value.

<Third Embodiment>

In the following a third embodiment will be explained.

An image forming apparatus 200 in the third embodiment is similar to that in the first embodiment, but is different in that a detecting portion detects an amount of use of the developing devices 4*a*–4*d*.

The configuration of the image forming apparatus 200 explained in the first embodiment is applicable also to the third embodiment and will not, therefore, be explained further.

A print sequence in the third embodiment includes steps similar to those in the first embodiment, but is different in the method of setting a continuous page number NA1 in the monochromatic printing.

A charge amount held by the toner generally varies depending on an amount of use of a developing device.

Also a force which the toner on the photosensitive drum 1 receives at the secondary transfer portion T2 by the secondary transfer bias (voltage) applied to the secondary transfer roller 9 becomes larger as the charge amount of the toner increases.

Further, a toner amount deposited on the intermediate transfer belt cleaning auxiliary roller 100 increases as the secondary transfer residual toner increases.

Based on the foregoing, a change in the amount of use of the developing device causes a change in the amount of the secondary transfer residual toner with a change in the charge amount of the toner, thereby causing a change in the toner amount deposited on the intermediate transfer belt cleaning auxiliary roller.

Therefore, if the continuous page number NA1 is set constant regardless of the amount of use of the developing device so as not to cause a drawback such as an insufficient cleaning even in an amount of use of the developing device inducing a high deposited toner amount, the deposited toner eliminating step is executed with an unnecessarily high frequency in an amount of use of the developing device inducing a low deposited toner amount, whereby the electric power is wasted for the bias application for the deposited toner eliminating step.

Therefore, the continuous page number NA1 is set by the following method in the present invention.

At first, a continuous printing operation is executed without executing the deposited toner eliminating step, and a page number at which the drawback such as the insufficient cleaning is experimentally determined in each of plural developing devices of different amounts of use.

Then a continuous page number NA1 for each of plural different amounts of use of the developing devices is stored in a storage portion (not shown) such as a memory provided in the engine controller 12 of the image forming apparatus 200.

The continuous page number NA1 to be stored may be the same as the experimentally determined page number, but is preferably selected smaller than the experimentally determined page number in order to avoid the foregoing drawback.

Then, the engine controller 12 refers to the amount of use detected by a use amount detecting portion for the developing device prior to the image formation, and reads the continuous page number NA1 corresponding to the detected amount of use, whereby the continuous page number NA1 can be appropriately selected matching the amount of use of the developing devices.

For a developing device capable of forming 6,000 image pages in total without causing an image defect, specific examples of the continuous page number NA1 are selected as follows.

In the monochromatic printing, the continuous page numbers NA1 of 30 pages until the total image page number, representing the amount of use of the developing device, reaches 2,000 pages; 20 pages until the total image page number, representing the amount of use of the developing device, reaches 4,000 pages; and 10 pages until the total image page number, representing the amount of use of the developing device, reaches 6,000 pages, are stored in the memory of the engine controller 12.

The engine controller 12 judges whether the total page number, detected by the use amount detecting portion for the developing device and indicating the amount of use of the developing device, is 2,000 or less, more than 2,000 but less than or equal to 4,000, or more than 4,000, and sets a continuous page number NA1 according to such amount of use of the developing device.

The aforementioned selection of the continuous page number NA1 is based on the following reason.

Experimentally, drawbacks such as a defective cleaning of the intermediate transfer belt 60 were observed when the deposited toner eliminating step was executed every 35 pages until the total image page number, representing the amount of use of the developing device, reaches 2,000 pages, every 25 pages until the total image page number, representing the amount of use of the developing device, reaches 4,000 pages, and every 15 pages until the total image page number, representing the amount of use of the developing device, reaches 6,000 pages. Thus, the set values were determined with margins in order to securely avoid such drawbacks.

In the third embodiment, as explained in the foregoing, the continuous page number, which indicates an interval of pages for executing the deposited toner eliminating step, is selected according to the amount of use of the developing device. Thus, it is rendered possible, in a monochromatic printing under an amount of use of the developing device inducing a low deposited toner amount, to prevent an excessive electric power consumption and a loss in the throughput, resulting from execution of the deposited toner eliminating step with an unnecessarily high frequency.

Also, the deposited amount of the secondary transfer residual toner varies in general by the amount of use of the intermediate transfer belt 60, thus resulting in a change in the deposited toner amount.

Therefore, effects similar to those explained above can also be obtained by setting the continuous page number NA1 according to the amount of use of the intermediate transfer belt 60.

More specifically, the deposited toner eliminating step can be executed at an appropriate timing matching the deposited toner amount, by decreasing the continuous page number NA1 for an increase in the amount of use of the intermediate transfer belt 60.

The aforementioned embodiments, as explained in the foregoing, provide an effect of eliminating the toner deposited on the charging means at an appropriate timing matching the amount of the deposited toner, thereby securely eliminating the residual toner remaining on the intermediate transfer member with a minimized loss in the productivity.

The aforementioned embodiments have been explained using a printer as an example of the image forming apparatus, but the present invention is not limited to such case and is applicable also to other image forming apparatus such as a copying apparatus or a facsimile, or a composite apparatus having a combination of these functions, and similar effects can be obtained by applying the present invention to such image forming apparatuses.

The present invention has been explained by various embodiments, but the spirit and scope of the present invention are not restricted by specific description or drawings in the present specification. For example, the intermediate transfer member is not limited to a belt-shaped member, and the present invention is applicable to an image forming apparatus utilizing an intermediate transfer drum. Also the photosensitive drum is not limited to one unit, and the present invention is applicable also to a system in which toner images are separately formed on plural photosensitive drums and are superposed on an intermediate transfer belt.

This application claims priority from Japanese Patent Application No. 2003-298824 filed Aug. 22, 2003, which is hereby incorporated by reference herein.

What is claimed is:

1. An image forming apparatus comprising:

a first image bearing member for bearing a toner image;

a movable second image bearing member;

charging means which charges a toner on the second image bearing member; and voltage applying means which applies a voltage to the charging means, wherein the toner image is transferred from the first image bearing member to the second image bearing member at a first transfer portion, and the toner image is transferred from the second image bearing member to a transfer material at a second transfer portion, wherein the charging means is opposed to the second image bearing member at a downstream side of the second transfer portion and at an upstream side of the first transfer portion with respect to a moving direction of the second image bearing member, and wherein the voltage applying means switches a DC voltage from a first voltage to a second voltage which is opposite in polarity to the first voltage, the switching from the first voltage to the second voltage being executed at each of a predetermined number of transfers of the toner image from the second image bearing member to the transfer material, the predetermined number varying depending on an image forming condition.

2. An image forming apparatus according to claim 1, further comprising:

second charging means which charges the toner on the second image bearing member, wherein the charging means is a first charging means, and the second charging means is opposed to the second image bearing member at a downstream side of a portion where the first charging means is opposed to the second image bearing member and at an upstream side of the first transfer portion with respect to the moving direction of the second image bearing member.

3. An image forming apparatus according to claim 2, wherein the second charging means is given a DC voltage which is a third voltage having a polarity the same as that of the first voltage.

4. An image forming apparatus according to claim 1 or 2, wherein the charging means charges a residual toner after transfer from the second image bearing member to the transfer material.

5. An image forming apparatus according to claim 1 or 2, wherein the switching from the first voltage to the second voltage at each of the predetermined number of transfers of the toner image, means that the switching from the first voltage to the second voltage is not executed for a predetermined number of transfers, among the transfers of the toner image from the second image bearing member to the transfer material, and is then executed for every transfer of the toner image from the second image bearing member to the transfer material.

6. An image forming apparatus according to claim 1 or 2, wherein the image forming condition is a number of superposed transfers of the toner image from the first image bearing member to the second image bearing member before the transfer of the toner image from the second image bearing member to the transfer material.

7. An image forming apparatus according to claim 1 or 2, further comprising:

humidity detecting means which detects a humidity around the image forming apparatus, wherein the image forming condition is a result of detection by the humidity detecting means.

8. An image forming apparatus according to claim 1 or 2, further comprising temperature detecting means which detects a temperature around the image forming apparatus, wherein the image forming condition is a result of detection by the temperature detecting means.

9. An image forming apparatus according to claim 1 or 2, further comprising developing means which develops the toner image on the first image bearing member, wherein the image forming condition is a history of use of the developing means.

* * * * *

UNITED STATES PATENT AND TRADEMARK OFFICE

CERTIFICATE OF CORRECTION

PATENT NO. : 7,113,713 B2
APPLICATION NO. : 10/921183
DATED : September 26, 2006
INVENTOR(S) : Soda et al.

It is certified that error appears in the above-identified patent and that said Letters Patent is hereby corrected as shown below:

COLUMN 1
Line 51, “a” (second occurrence) should be deleted.
Line 52, “a” (third occurrence) should be deleted.
Line 53, “charging” (second occurrence) should be deleted.
Line 55, “voltage” (second occurrence) should be deleted.
Line 56, “wherein the” should be deleted.
Line 58, “the” should be deleted.
Line 65, “the” should be deleted.
Line 67, “the” (second occurrence) should be deleted.

COLUMN 4
Line 22, “voltage” (second occurrence) should read --voltage,--.

COLUMN 5
Line 64, “clean” should read --cleaning--.

COLUMN 11
Line 27, “same” should read --the same--.

Signed and Sealed this

Second Day of September, 2008

JON W. DUDAS
*Director of the United States Patent and Trademark Office*